US008227681B2

(12) United States Patent
Ulicny et al.

(10) Patent No.: US 8,227,681 B2
(45) Date of Patent: Jul. 24, 2012

(54) ACTIVE MATERIAL APPARATUS WITH ACTIVATING THERMOELECTRIC DEVICE THEREON AND METHOD OF FABRICATION

(75) Inventors: John C. Ulicny, Oxford, MI (US); Jihui Yang, Lakeshore (CA); Mark W. Verbrugge, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 983 days.

(21) Appl. No.: 11/780,502

(22) Filed: Jul. 20, 2007

(65) Prior Publication Data

US 2009/0020188 A1 Jan. 22, 2009

(51) Int. Cl.

| | |
|---|---|
| ***H01L 35/00*** | (2006.01) |
| ***H01L 37/00*** | (2006.01) |
| ***C22F 1/00*** | (2006.01) |
| ***H02N 10/00*** | (2006.01) |

(52) U.S. Cl. ..... 136/200; 148/402; 310/306

(58) Field of Classification Search ..... 136/200; 148/402; 310/306

See application file for complete search history.

(56) References Cited

U.S. PATENT DOCUMENTS

| | | | | |
|---|---|---|---|---|
| 6,247,738 | B1 * | 6/2001 | Winkel et al. | 294/111 |
| 6,499,952 | B1 * | 12/2002 | Jacot et al. | 416/155 |
| 6,835,083 | B1 * | 12/2004 | Alacqua et al. | 439/310 |
| 7,188,473 | B1 * | 3/2007 | Asada et al. | 60/527 |
| 2001/0018606 | A1 * | 8/2001 | Ingle et al. | 607/116 |

FOREIGN PATENT DOCUMENTS

| | | | |
|---|---|---|---|
| JP | 61014771 | * | 1/1986 |
| JP | 09-123330 | * | 5/1997 |

OTHER PUBLICATIONS

Translation of JP61014771, pub. Jan. 1986.*

Computer translation of JP09-123330, pub. May 1997.*

A Bhattacharyya, D C Lagoudas, Y Wang and V K Kinra, "On the Role of Thermoelectric Heat Transfer in the Design of SMA Actuators: Theoretical Modeling and Experiment", Smart Mater. Struct. 4, Sep. 6, 1995, pp. 252-263, United Kingdom.

* cited by examiner

*Primary Examiner* — Basia Ridley
*Assistant Examiner* — Allison Bourke
(74) *Attorney, Agent, or Firm* — Quinn Law Group, PLLC

(57) ABSTRACT

An active material assembly is provided having a thermally-activated active material apparatus with an elongated, non-planar shape and a thermoelectric device in thermal contact therewith. The thermoelectric device is characterized by a thermal differential when current flows through the device to activate the thermally-activated active material apparatus, thereby altering at least one dimension thereof. Multiple discrete thermoelectric devices may be in thermal contact with the active material apparatus and electrically in parallel with one another. The active material apparatus, which may be multiple active material components, each with one of the thermoelectric devices thereon, may be encased within a flexible electronic-insulating material to form an articulated active material assembly that can achieve different geometric shapes by separately activating one or more of the different thermoelectric devices. A method of fabricating an articulated active material assembly is also provided.

4 Claims, 4 Drawing Sheets

ACTIVE MATERIAL APPARATUS WITH ACTIVATING THERMOELECTRIC DEVICE THEREON AND METHOD OF FABRICATION

TECHNICAL FIELD

The invention relates to an active material apparatus, which may include one or more active material components, with at least one thermoelectric device thereon to cause activation and resulting change in a physical characteristic of the apparatus, and also to a method of fabricating an active material assembly.

BACKGROUND OF THE INVENTION

Active materials include those compositions that can exhibit a change in stiffness properties, shape and/or dimensions in response to an activation signal, which can be an electrical, magnetic, thermal or a like field depending on the different types of active materials. Preferred active materials include but are not limited to the class of shape memory materials, and combinations thereof. Shape memory materials, also sometimes referred to as smart materials, refer to materials or compositions that have the ability to "remember" their original shape, which can subsequently be "recalled" by applying an external stimulus (i.e., an activation signal). As such, deformation of the shape memory material from the original shape can be a temporary condition.

Shape memory materials such as shape memory alloys (SMAs) and polymers (SMPs) represent a class of thermally-activated smart materials (TASMs) that undergo a reversible phase transformation responsible for dramatic stress-induced and temperature-induced recoverable deformation behavior. SMAs and SMPs have been used for some years to produce novel and useful devices such as control actuators, deformable composite structures and various kinds of medical devices.

SUMMARY OF THE INVENTION

One of the limitations of TASMs is the cycling rate of the phase transformation, which is limited by the rate at which the temperature of the TASMs can be changed. Typical heat transfer methods, such as fluid convection, provide heating and cooling response time on the order of seconds. Additionally, TASMs have an upper use temperature limit beyond which the reversibility of the phase change is not available.

The present invention is designed to reduce these limitations by embedding a thermoelectric (TE) device, i.e., a TE heating/cooling unit, on a thermally-activated active material apparatus to provide thermal contact with the active material apparatus and thus increase the heating/cooling rates. With such direct thermal contact, the ultimate cycling rate of a thermally-activated active material apparatus can be increased or the temperature of a thermally-activated active material apparatus can be better controlled within allowable limits as an inherent function of the thermally-activated active material apparatus.

Accordingly, an active material assembly is provided that includes a thermally-activated active material apparatus characterized by an elongated, nonplanar shape. The active material assembly is also referred to herein as a smart wire. The assembly further includes a thermoelectric device placed in thermal contact with the thermally-activated active material apparatus. The thermoelectric device is characterized by a thermal differential when current flows through the device. As used herein, a "thermal differential" is a temperature difference between the thermoelectric device and the thermally-activated active material apparatus and may cause either heating or cooling of the thermally-activated active material apparatus, depending on the direction of current flow in the thermoelectric device. The thermally-activated active material apparatus is activated by the thermal differential to alter at least one physical characteristic of the thermally-activated active material apparatus. The altered characteristic may be a dimensional change, such as a change in length or width, any shape change, or a change in stiffness modulus.

"Activation" of an active material apparatus means that a signal or trigger is provided to begin actuation (contraction, expansion, bending or other shape change) of the active material apparatus. The active material apparatus used herein is activated thermally by heat transfer, which causes either heating or cooling of the active material apparatus, and which is triggered by current flow in the thermoelectric device. The temperature change of the active material apparatus could optionally also be supplemented by radiant heating, fluidic (convective) heating or cooling, or any combination of the above.

The thermally-activated active material apparatus has an elongated, nonplanar shape which in cross-section may be generally rectangular, cylindrical or another cross-sectional shape. The assembly may be referred to herein as a smart wire, as it may be used as an actuator to impart force generated by the activation of the active material apparatus therein.

Preferably, multiple thermoelectric devices are placed in thermal contact with the thermally-activated active material apparatus. The active material apparatus may include one active material component with the multiple thermoelectric devices on different portions thereof, or multiple active material components, each with a thermoelectric device thereon. Each thermoelectric device can be excited separately from the others to activate the active material component it contacts in response to the thermal differential of the respective thermoelectric device. Thus, precise control of the geometric shape of the assembly is possible by energizing different individual thermoelectric devices to cause activation in different portions of the active material apparatus if a single active material component is used, or in different active material components if multiple active material components are used.

The thermally-activated active material apparatus is characterized by a reversible phase transformation activated by heat transfer that causes a dimensional change in the active material apparatus. If the thermally-activated active material assembly includes multiple thermoelectric devices on the thermally-activated active material apparatus (i.e., is articulated), the thermoelectric devices may thus be separately heated and/or cooled to achieve a variety of controlled shape changes in the apparatus. Optionally, separate activation of the active material apparatus by resistive heating may be obtained by attaching a voltage source to the active material apparatus or to a metal strip on the thermally-activated active material assembly. In such embodiments, the thermoelectric devices may be used in combination with the resistive heating by the separate voltage source to cool different portions of the active material apparatus if a single active material component is used, or different active material components if multiple active material components are used, to thereby achieve a desired articulated shape.

The active material assembly may include an electronic-insulating layer sandwiched between the thermally-activated active material apparatus and the thermoelectric device. The electronic-insulating layer has a generally electronic-insulating characteristic that insulates the thermally-activated active material apparatus from current flow in the thermoelectric device.

The thermoelectric device includes at least one negatively-doped thermoelement and at least one positively-doped thermoelement connected electrically in series with one another, but thermally in parallel. Preferably, there are multiple pairs of a negatively-doped thermoelement and a positively-doped thermoelement.

The thermoelectric device preferably includes a first metal contact layer sandwiched between the electronic-insulating layer and the thermoelements. A second metal contact layer connects adjacent pairs of the negatively-doped and positively-doped thermoelements. The first metal contact layer and the second metal contact layer may also be referred to herein as a lower ohmic contact layer and an upper ohmic contact layer, respectively, as each metal contact layer has islands of ohmic contact to allow current flow therethrough without a substantial amount of heating at the junctions. The ohmic contact may be established by photolithographic means that are known to those skilled in the art.

Preferably the thermally-activated active material apparatus is a shape memory material, such as a shape memory alloy. Because the apparatus changes dimension and because the thermoelectric device or devices are on the electronic-insulating layer, this layer is preferably a polymer, and possibly a shape memory polymer, that has comparable elongational properties to the thermally-activated active material apparatus. Similarly, it is preferable that the first and second metal contact layers are alloys, and possibly shape memory alloys, having elongational properties comparable to the thermally-activated active material apparatus and the electronic-insulating layer.

The entire active material apparatus with thermoelectric device or devices thereon may be encased in a flexible electronic-insulating layer such as a thermoplastic ohmic layer to cover the thermally-activated active material apparatus and thermoelectric device, thereby forming the smart wire.

A method of fabricating an articulated active material assembly is also provided. The method includes placing a first thermoelectric device in thermal contact with a generally elongated active material apparatus. The method further includes placing a second thermoelectric device in thermal contact with the generally elongated, active material apparatus. Again, the active material apparatus may be one active material component, with a different thermoelectric device placed in thermal contact with different portions of the active material component. Alternatively, the thermally-activated active material apparatus may be separate, electrically-isolated active material components, with a different thermoelectric device in thermal contact with each different component. The first and second thermoelectric devices form separately excitable electric circuits and each are characterized by a thermal differential when current flows therethrough to cause a phase transformation in the active material apparatus. A dimensional or other physical characteristic change of the active material apparatus is thereby achieved by controlling the polarity and amplitude of current flow in the different thermoelectric devices.

Placing the first thermoelectric device in thermal contact with the thermally-activated active material apparatus includes many substeps such as placing an electronic-insulating layer on the thermally-activated active material apparatus, and placing a first metal contact layer on the electronic-insulating layer. A first polymer mask is deposited on the first metal contact layer. Planar processing techniques such as photolithography are applied to the first polymer mask to permit depositing of an n-type thermoelement in ohmic contact with the first metal contact layer. Planar processing techniques are also used to permit ohmic contact between the first metal contact layer and a p-type thermoelement. For example, a second polymer mask is deposited on the first metal contact layer. Planar processing techniques are used so that a P-type, i.e., positively-doped, thermoelement may be deposited to allow ohmic contact with the first metal contact layer. Planar processing techniques are also used to create ohmic contact between a second metal contact layer and adjacent n-type and p-type thermoelements that are on different metal contact layers. For example, a third polymer mask is deposited over the adjacent n-type and p-type thermoelements with a second metal contact layer placed thereon, and planar processing is used to allow ohmic contact with the second metal contact layer, also referred to herein as the upper ohmic contact layer.

The active material apparatus may be, but is not limited to, a class of active materials called shape memory materials. Exemplary shape memory materials include shape memory alloys (SMAs), electroactive polymers (EAPs) such as dielectric elastomers, ionic polymer metal composites (IPMC), piezoelectric polymers and shape memory polymers (SMPs), magnetic shape memory alloys (MSMA), shape memory ceramics (SMCs), baroplastics, piezoelectric ceramics, magnetorheological (MR) elastomers, composites of the foregoing shape memory materials with non-shape memory materials, and combinations comprising at least one of the foregoing shape memory materials. For convenience and by way of example, reference herein will be made to shape memory alloys and shape memory polymers. The shape memory ceramics, baroplastics, and the like can be employed in a similar manner as will be appreciated by those skilled in the art in view of this disclosure. For example, with baroplastic materials, a pressure induced mixing of nanophase domains of high and low glass transition temperature (Tg) components effects the shape change. Baroplastics can be processed at relatively low temperatures repeatedly without degradation. SMCs are similar to SMAs but can tolerate much higher operating temperatures than can other shape-memory materials. An example of an SMC is a piezoelectric material.

The ability of shape memory materials to return to their original shape upon the application of external stimuli has led to their use in actuators to apply force resulting in desired motion. Smart material actuators offer the potential for a reduction in actuator size, weight, volume, cost, noise and an increase in robustness in comparison with traditional electromechanical and hydraulic means of actuation.

Shape memory alloys are alloy compositions with at least two different temperature-dependent phases. The most commonly utilized of these phases are the so-called martensite and austenite phases. In the following discussion, the martensite phase generally refers to the more deformable, lower temperature phase whereas the austenite phase generally refers to the more rigid, higher temperature phase. When the shape memory alloy is in the martensite phase and is heated, it begins to change into the austenite phase. The temperature at which this phenomenon starts is often referred to as austenite start temperature ($A_s$). The temperature at which this phenomenon is complete is often called the austenite finish temperature ($A_f$). When the shape memory alloy is in the austenite phase and is cooled, it begins to change into the martensite phase, and the temperature at which this phenomenon starts is often referred to as the martensite start temperature ($M_s$). The temperature at which austenite finishes transforming to martensite is often called the martensite finish temperature ($M_f$). The range between $A_s$ and $A_f$ is often referred to as the martensite-to-austenite transformation temperature range while that between $M_s$ and $M_f$ is often called the austenite-to-martensite transformation temperature range. It should be noted that the above-mentioned transition temperatures are functions of the stress experienced by the shape memory alloy sample. Generally, these temperatures increase with increasing stress. In view of the foregoing properties, deformation of the shape memory alloy is applied preferably at or below the austenite start temperature (at or below $A_s$). Subsequent heating above the austenite start temperature causes the deformed shape memory material sample to begin to revert back to its original (nonstressed) permanent shape until completion at the austenite finish temperature. Thus, a suitable activation input or signal for use with shape memory alloys is a thermal activation signal having a magnitude that is sufficient to cause transformations between the martensite and austenite phases.

The temperature at which the shape memory alloy remembers its high temperature form (i.e., its original, nonstressed shape) when heated can be adjusted by slight changes in the composition of the alloy and through thermo-mechanical processing. In nickel-titanium shape memory alloys, for example, it can be changed from above about 100 degrees Celsius to below about −100 degrees Celsius. The shape recovery process can occur over a range of just a few degrees or exhibit a more gradual recovery over a wider temperature range. The start or finish of the transformation can be controlled to within several degrees depending on the desired application and alloy composition. The mechanical properties of the shape memory alloy vary greatly over the temperature range spanning their transformation, typically providing a shape memory effect and a superelastic effect. For example, in the martensite phase, a lower elastic modulus than in the austenite phase is observed. Shape memory alloys in the martensite phase can undergo large deformations by realigning the crystal structure arrangement with the applied stress. As will be described in greater detail below, the material will retain this shape after the stress is removed.

Suitable shape memory alloy materials include, but are not intended to be limited to, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-palladium based alloys, and the like. The alloys can be binary, ternary, or any higher order so long as the alloy composition exhibits a shape memory effect, e.g., change in shape, orientation, yield strength, flexural modulus, damping capacity, superelasticity, and/or similar properties. Selection of a suitable shape memory alloy composition depends, in part, on the temperature range of the intended application.

The recovery to the austenite phase at a higher temperature is accompanied by very large (compared to that needed to deform the material) stresses which can be as high as the inherent yield strength of the austenite material, sometimes up to three or more times that of the deformed martensite phase. For applications that require a large number of operating cycles, a strain in the range of up to 4% or more of the deformed length of wire used can be obtained.

As previously mentioned, other suitable shape memory materials are shape memory polymers (SMPs). "Shape memory polymer" generally refers to a polymeric material, which exhibits a change in a physical property, such as a shape, a dimension, a shape orientation, or a combination comprising at least one of the foregoing properties in combination with a change in its elastic modulus upon application of an activation signal. Shape memory polymers may be thermoresponsive (i.e., the change in the property is caused by a thermal activation signal), photoresponsive (i.e., the change in the property is caused by a light-based activation signal), moisture-responsive (i.e., the change in the property is caused by a liquid activation signal such as humidity, water vapor, or water), or a combination comprising at least one of the foregoing.

Generally, shape memory polymers are phase segregated co-polymers comprising at least two different units, which may be described as defining different segments within the shape memory polymer, each segment contributing differently to the overall properties of the shape memory polymer. As used herein, the term "segment" refers to a block, graft, or sequence of the same or similar monomer or oligomer units, which are copolymerized to form the shape memory polymer. Each segment may be crystalline or amorphous and will have a corresponding melting point or glass transition temperature ($T_g$), respectively. The term "thermal transition temperature" is used herein for convenience to generically refer to either a Tg or a melting point depending on whether the segment is an amorphous segment or a crystalline segment. For shape memory polymers comprising (n) segments, the shape memory polymer is said to have a hard segment and (n−1) soft segments, wherein the hard segment has a higher thermal transition temperature than any soft segment. Thus, the shape memory polymer has (n) thermal transition temperatures. The thermal transition temperature of the hard segment is termed the "last transition temperature", and the lowest thermal transition temperature of the so-called "softest" segment is termed the "first transition temperature". It is important to note that if the shape memory polymer has multiple segments characterized by the same thermal transition temperature, which is also the last transition temperature, then the shape memory polymer is said to have multiple hard segments.

When the shape memory polymer is heated above the last transition temperature, the shape memory polymer material can be imparted a permanent shape. A permanent shape for the shape memory polymer can be set or memorized by subsequently cooling the shape memory polymer below that temperature. As used herein, the terms "original shape", "previously defined shape", "predetermined shape", and "permanent shape" are synonymous and are intended to be used interchangeably. A temporary shape can be set by heating the material to a temperature higher than a thermal transition temperature of any soft segment yet below the last transition temperature, applying an external stress or load to deform the shape memory polymer, and then cooling below the particular thermal transition temperature of the soft segment while maintaining the deforming external stress or load.

The permanent shape can be recovered by heating the material, with the stress or load removed, above the particular thermal transition temperature of the soft segment yet below the last transition temperature. Thus, it should be clear that by combining multiple soft segments it is possible to demonstrate multiple temporary shapes and with multiple hard segments it may be possible to demonstrate multiple permanent shapes. Similarly using a layered or composite approach, a combination of multiple shape memory polymers will demonstrate transitions between multiple temporary and permanent shapes.

Suitable shape memory polymers can be thermoplastics, interpenetrating networks, semi-interpenetrating networks, or mixed networks. The polymers can be a single polymer or a blend of polymers. The polymers can be linear or branched thermoplastic elastomers with side chains or dendritic structural elements. Suitable polymer components used to form a shape memory polymer include, but are not limited to, polyphosphazenes, poly(vinyl alcohols), polyamides, polyester amides, poly(amino acids)s, polyanhydrides, polycarbonates, polyacrylates, polyalkylenes, polyacrylamides, polyalkylene glycols, polyalkylene oxides, polyalkylene terephthalates, polyortho esters, polyvinyl ethers, polyvinyl esters, polyvinyl halides, polyesters, polylactides, polyglycolides, polysiloxanes, polyurethanes, polyethers, polyether amids, polyether esters, and copolymers thereof.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
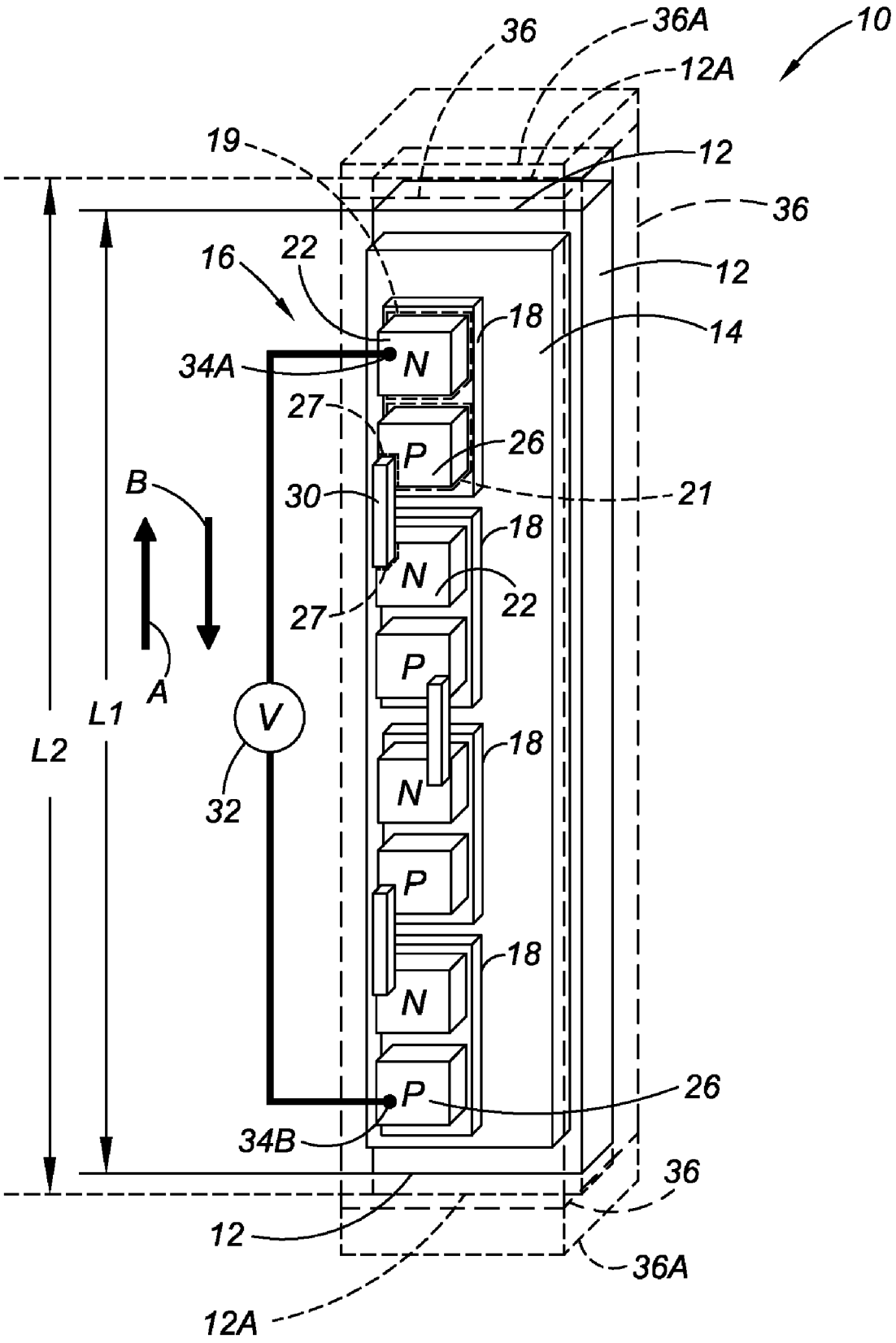
FIG. 1 is a schematic perspective illustration of a first embodiment of an active material assembly within the scope of the invention.

Referring to the drawings wherein like reference numbers refer to like components, FIG. 1 shows an active material assembly 10, which is referred to herein as a smart wire. The active material assembly 10 includes a thermally-activated active material apparatus 12 which, in this embodiment, is a single active material component and may be referred to as such. Preferably, the active material apparatus 12 is a shape memory alloy with a lateral size (i.e., a width or thickness in the case of an active material apparatus with a non-circular cross-section, or a diameter in the case of an active material apparatus with a circular cross-section) of approximately 1 mm. The active material apparatus 12 is elongated in that its length is greater than its lateral size, as is apparent in FIG. 1. The active material apparatus 12 is shown with an elongated rectangular shape; however, an elongated cylindrical shape or other elongated shape may be used as well. The active material apparatus 12 is shown in a preactivation state, such as a martensite state. In this state, the active material apparatus 12 has a length L1.

A thin electronic-insulating layer 14 is deposited on the active material apparatus 12 on an outer surface thereof. Preferably, the electronic-insulating layer 14 is a shape memory polymer that has an elongational property comparable to the active material apparatus 12. The electronic-insulating layer 14 insulates the active material apparatus 12 from electrical activity in a thermoelectric device 16, described below. However, the electronic-insulating layer 14 does not create a thermal barrier between the active material apparatus 12 and the thermoelectric device 16 so that a thermal differential in the thermoelectric device 16 causes heat transfer in the active material apparatus 12 in response to the thermal differential. The thermoelectric device 16 includes multiple metal contact layers 18 deposited on the electronic-insulating layer 14. The metal contact layers 18 are also referred to herein as first or inner ohmic contact layers.

On each of the first metal contact layers 18, a first polymer mask 19 is deposited. Known planar processing techniques, such as photolithography are used to permit ohmic contact of the first metal contact layer 18 with an n-type or negatively-doped thermoelement layer 22, labeled N, deposited thereon. A second polymer mask 21 is deposited on each separate metal contact layer 18 and subjected to known planar processing techniques at proper locations to permit a p-type or positively-doped thermoelement layer 26 to be deposited in ohmic contact with the first metal contact layer 18.

Between each metal contact layer 18, a second metal contact layer 30, also referred to herein as an upper ohmic contact layer, connects each positively-doped thermoelement 26 on one first metal contact layer 18 with a negatively-doped thermoelement 22 on the adjacent metal contact layer 18. A third polymer mask 27 is deposited on the thermoelements 22 and 26 and is subjected to known planar processing techniques so that the adjacent thermoelements 22, 26 may be electrically connected via a second metal contact layer 30.

Because they are substantially or completely removed by the planar processing, the first, second, and third polymer masks 19, 21, 27 are indicated only by phantom lines outlining the general area at which they were deposited. The masks 19, 21 and 27 are indicated only at two of the n-type thermoelements 22 and one of the p-type thermoelements 26; however, it should be understood that the masks 19, 21 and 27 are deposited at corresponding locations on each of the thermoelements shown in FIG. 1. The thermoelements 22 and 26 are labeled on only one of the first metal contact layers 18 in FIG. 1, but like components are shown as well on each of the other first metal contact layers 18. Preferably, the first and second metal contact layers 18, 30 are shape memory alloys or are of another material that has elongational properties comparable to the active material apparatus 12 and the electronic-insulating layer 14, as well as good ohmic contact with the p-type and n-type thermoelements 26 and 22.

A power source 32 such as a battery is connected electrically at electrical contacts 34A, 34B to the outermost n-type thermoelement 22 and the outermost p-type thermoelement 26 to create an electrical circuit within the thermoelectric device 16. The thermoelectric device 16 is able to heat or cool the active material apparatus 12 by virtue of the Peltier effect. The power source 32 may cause current to flow in either direction (i.e., from the top thermoelement to the bottom thermoelement in FIG. 1, or vice versa) as indicated by the arrows A and B. When electrical current is applied in one direction, the thermoelectric device 16 causes heating of the active material apparatus 12. Switching polarity of the electrical current creates the opposite effect, and the thermoelectric device 16 cools the active material apparatus 12. The metal contact layers 18 and electronic-insulating layer 14 allow a thermal differential established by the current flow in the n and p-type thermal elements to be directly transferred to the active material apparatus 12. The second metal contact layers 30 connect each adjacent first metal contact layer 18 to complete the electrical circuit in the thermoelectric device 16. The heat transfer through the active material apparatus 12 is such that the reversible phase transformation is activated and the active material apparatus 12 transforms from a martensite state to an austenite state with the resulting change in overall length from L1 to L2 (new length in the austenite state L2 indicated with phantom dashed lines). The active material component in the activated state is referred to as 12A. Because the electronic-insulating layer 14 and the metal contact layers 18 and 30 have similar elongation properties, they also grow in length (although this is not indicated for purposed of clarity in FIG. 1).

The active material apparatus 12 and thermoelectric device 16 may be covered by (i.e., embedded in) a flexible, electronic-insulating material 36 shown in phantom in FIG. 1 that acts as an outer casing. The electronic-insulating material 36 may be a thermoplastic. The outer casing provided by the flexible electronic-insulating material 36 gives the entire assembly 10 the appearance of a uniform elongated unit, which may be referred to as a smart wire. When the active material component is in the activated state 12A, the electronic-insulating casing also elongates and is referred to as 36A in the elongated state. Preferably the first and second metal contact layers 18, 30 as well as the electronic-insulating layer 14, also elongate in the activated state, although for purposes of clarity these components are shown only with a preactivation dimension or length in FIG. 1.

Figure 2A:
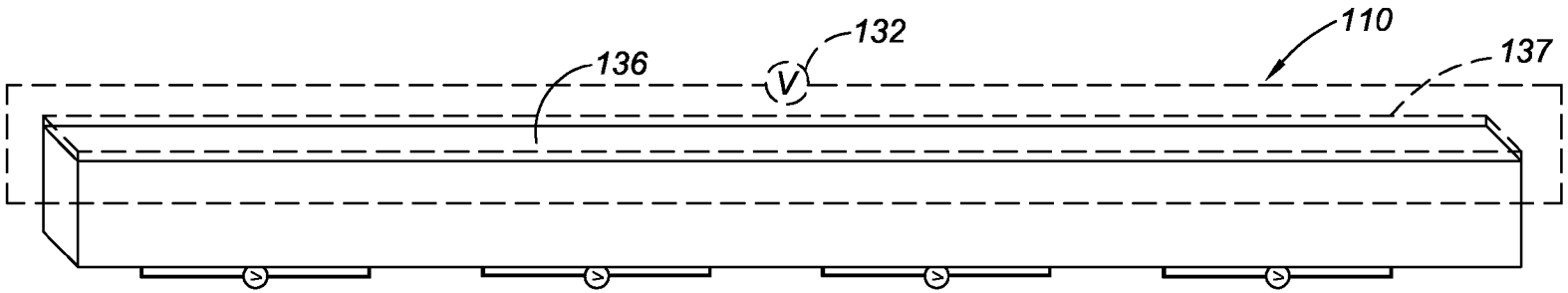
FIG. 2A is a schematic perspective illustration of a second embodiment of an active material assembly within the scope of the invention, with the active material components therein in an unactivated state.
Figure 2B:
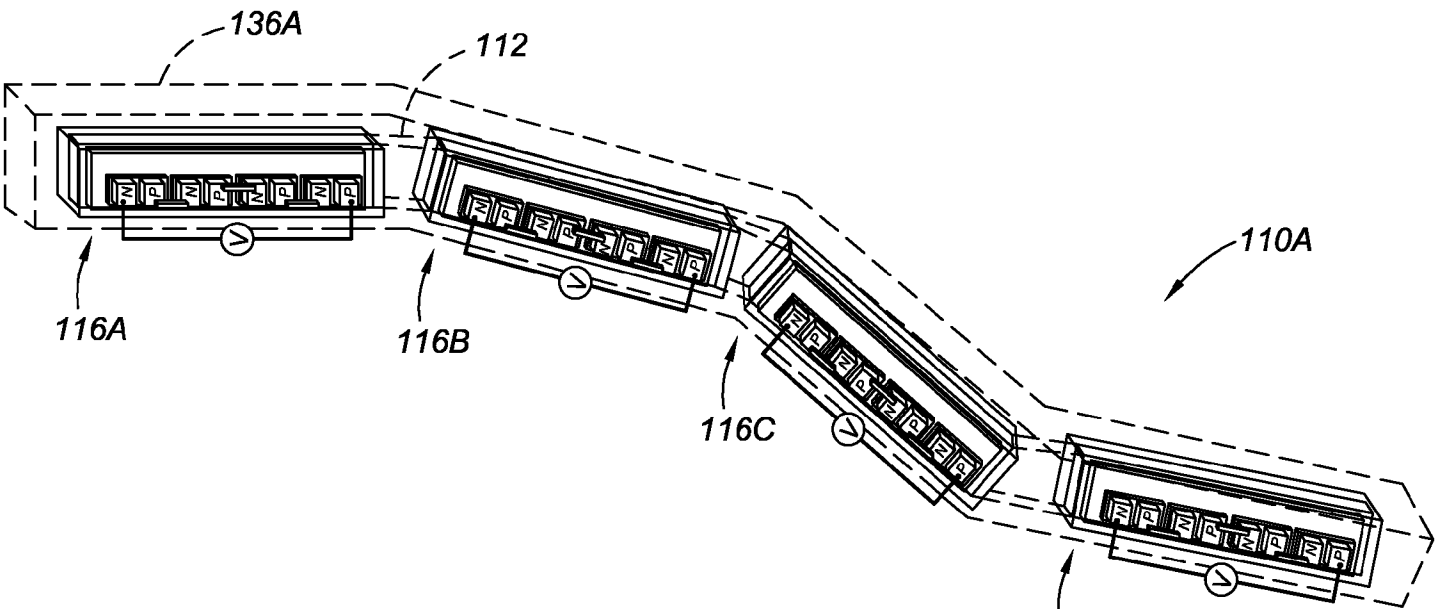
FIG. 2B is a schematic illustration of the active material assembly of FIG. 2A when activated.

Referring to FIGS. 2A and 2B, a second active material assembly 110, which is another embodiment of a smart wire, is shown in a preactivation or martensite state in FIG. 2A and in an activated state in FIG. 2B in which the active material assembly is referred to with reference number 110A. In this embodiment, the active material assembly 110A includes a number of discrete active material components, each with a thermoelectric device in thermal contact therewith, each being similar to the active material assembly or smart wire 10 of FIG. 1. The discrete thermoelectric devices and active material components are visible in FIG. 2B and are referenced as units 116A, 116B, 116C, and 116D. Alternatively, the active material assembly 110 may have a common, single, continuous active material component 112 running through all of the units 116A-116D in contact with each of the thermoelectric devices thereon, as represented by the connection in phantom running through the center of each unit 116A-116D in FIG. 2B.

In FIG. 2A, an encasing material 136 that is a flexible electronic isolating material encases all of the discrete units 116A-116B. In FIG. 2B, the encasing material is referred to as 136A when the active material assembly 110A is activated, as it also changes shape, and is shown in phantom so that the embedded discrete units 116A-116D are visible. The units 116A-116D are spaced from one another within the encasing material 136A, such that each is electrically isolated from and separately electrically excitable from the others. This allows separate control of each thermoelectric device. For example, the unit 116B may be cooled, the unit 116C heated, and units 116A and 116D not activated. Because the active material assembly 110 has discrete thermoelectric devices connected therewith that are separately excitable, i.e., the assembly 110 is articulated, the overall change in the shape of the assembly after activation may be greatly varied. The number and placement of the discrete units 116A-116D, as well as the precise geometric characteristics of the assembly 110 is dependent on the requirements and planned usage of the assembly 110.

Figure 3A:
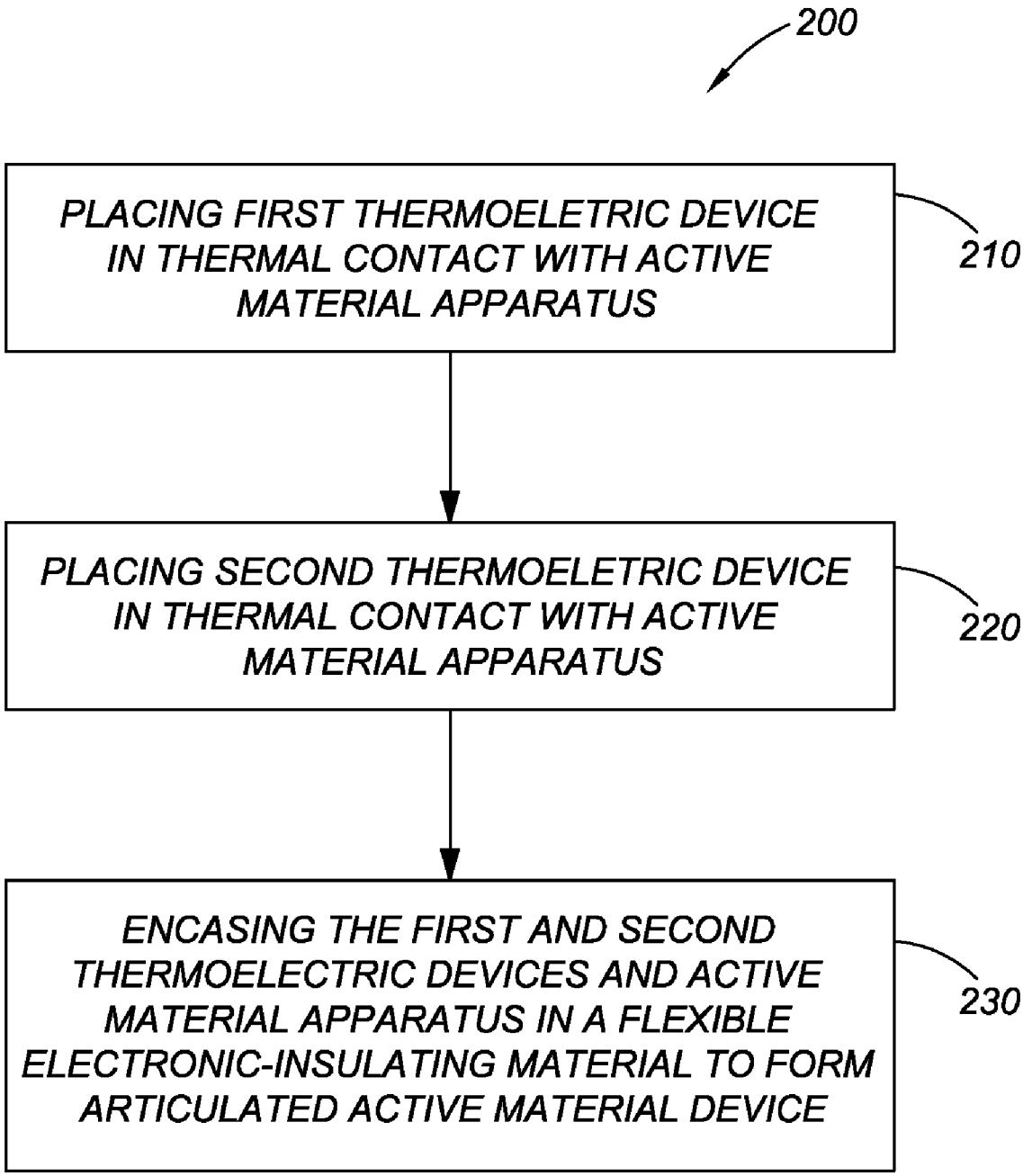
FIG. 3A is a flowchart representing a method of fabricating an articulated active material assembly.
Figure 3B:
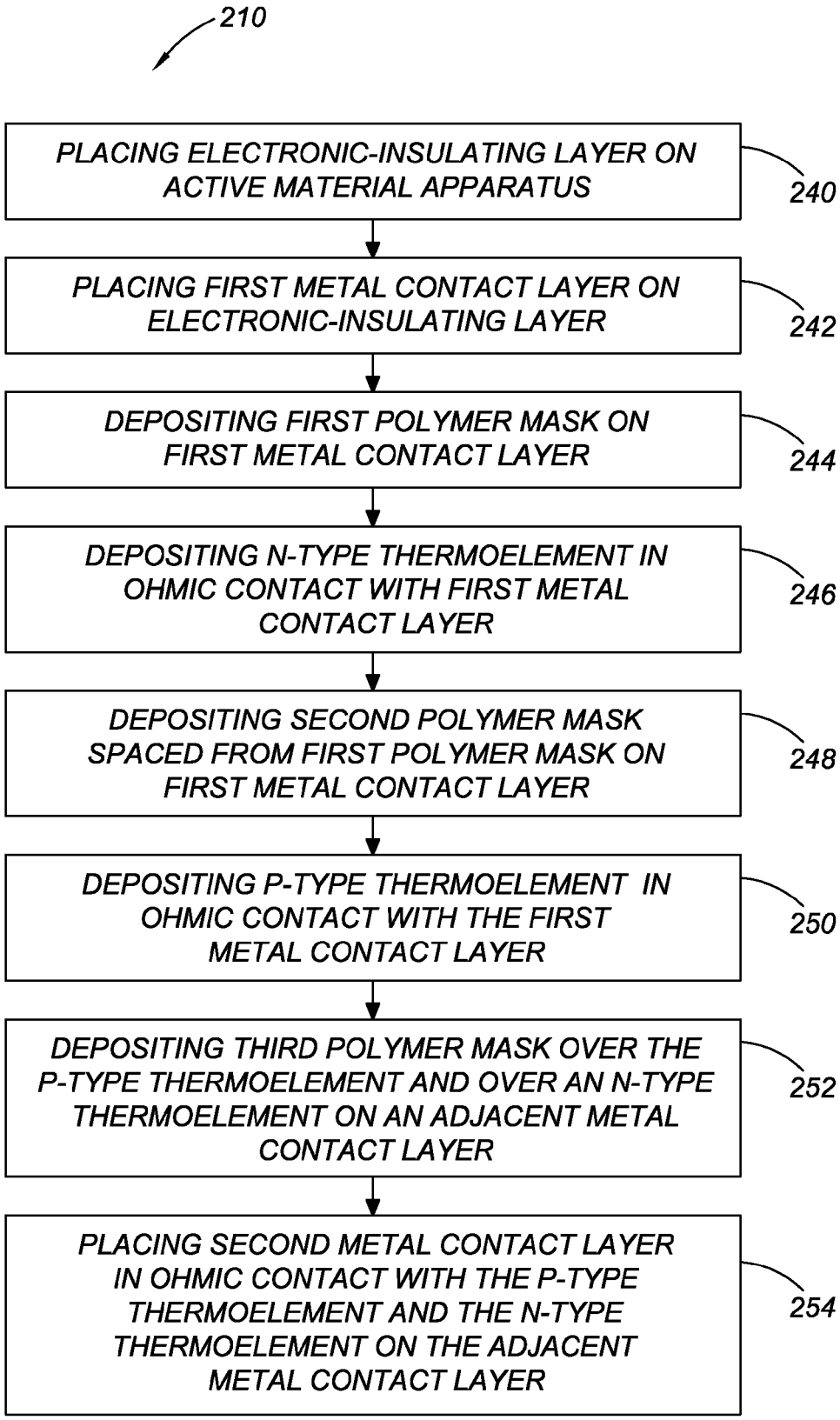
FIG. 3B is a flowchart representing substeps of one of the steps of the method of FIG. 3A.

Referring to FIGS. 3A and 3B, a method 200 of fabricating an articulated active material assembly (such as the active material assembly 110 shown in FIG. 2A in an inactivated state and in an activated state as 110A in FIG. 2B) is illustrated. The method 200 includes step 210, placing a first thermoelectric device in thermal contact with an active material apparatus to form a first active material unit such as unit 116A of FIG. 2B. The method 200 further includes step 220, placing a second thermoelectric device in thermal contact with an active material apparatus to form a second discrete active material unit such as unit 116B of FIG. 2B. The active material apparatus may include a separate, discrete, active material component for each unit, or a common, continuous active material component may be employed, with the first and second thermoelectric devices on different portions of the component, as described with respect to FIG. 2B. The method 200 then includes step 230, encasing the first and second units 116A and 116B in a flexible electronic-insulating layer, such as casing 136 of FIG. 2A, to form an articulated active material assembly 110 (the casing is referred to as 136A and the assembly as 110A in FIG. 2B when the active material apparatus is activated).

Referring to FIG. 3B, step 210 is illustrated in more detail. In a preferred embodiment, step 210 includes sub-steps 240 through 254. Step 240 requires the placing of an electronic-insulating layer on the first active material apparatus. Referring to FIG. 2B, unit 116A is identical to the smart wire 10 of FIG. 1. Thus, placing an electronic-insulating layer 14 on the first active material apparatus 12 pursuant to step 240 is illustrated by FIG. 1.

Step 210 further includes step 242, placing a first metal contact layer 18 on the electronic-insulating layer 14. Step 210 next includes step 244, depositing a first polymer mask 19 on the first metal contact layer 18. After the depositing step 244, step 246 requires depositing an n-type thermoelement 22 in ohmic contact with the first metal contact layer 18. The first polymer mask 19 is removed by known planar processing techniques during or after depositing step 246. The depositing step 246 may be chemical vapor deposition or other known planar processing techniques.

Step 210 next includes step 248, depositing a second polymer mask 21 spaced from the first polymer mask 19 on the first metal contact layer 18. Next, step 250 is carried out, which requires depositing the p-type thermoelement 26 in ohmic contact with the first metal contact layer 18. The second polymer mask 21 is removed by known planar processing techniques during or after depositing step 250. Again, the depositing step 250 may be by chemical vapor deposition or other known planar processing techniques.

Step 210 next requires step 252, depositing a respective third polymer mask 27 over each respective p-type thermoelement 26 and respective adjacent n-type thermoelement 22 that is on an adjacent metal contact layer. Next, step 254 requires placing a respective second metal contact layer 30 to create an electrical connection between each adjacent n-type and p-type thermoelement pair. Each respective third polymer mask 27 would be deposited in step 252 over the adjacent n-type and p-type thermoelements in the area that each second metal contact layer 30 covers in FIG. 1. However, the third polymer mask 27 is removed by known planar processing techniques during or after depositing step 254. Step 220 may involve steps similar or identical to steps 240-254 for a second smart wire unit such as unit 116B of FIG. 2B. Although FIG. 2B shows a separate encasing material similar to encasing material 36 of FIG. 1 surrounding each discrete unit 116A-116B in addition to encasement material 136A surrounding all units 116A-116D, conceivably, the separate encasing material for each discrete unit could be eliminated and encasing material 136A may be used alone to surround each discrete unit 116A-116D.

Optionally, the method 200 may include placing an additional voltage source 132 in operative contact with the active material apparatus for activation of the active material apparatus by resistive heating, and then selective cooling of different portions of the active material apparatus (or different components thereof if the apparatus includes multiple active material components) by selectively exciting individual thermoelectric devices on the different units 116A-116B. As another alternative, the method 200 may include placing a resistive metal strip 137 on the encasing material and connecting a voltage source to the metal strip 137. In such an embodiment, the voltage source 132 would be operatively connected to the ends of the metal strip in FIG. 2A, rather than to the active material apparatus. Running current through the metal strip 137 will cause resistive heating of the metal strip 137 and accompanying thermal heating of the active material apparatus 112 to activate the active material apparatus 112.

While the best modes for carrying out the invention have been described in detail, those familiar with the art to which this invention relates will recognize various alternative designs and embodiments for practicing the invention within the scope of the appended claims.

The invention claimed is:

1. An active material assembly comprising:

a first and a second thermally-activated active material apparatus;

a first thermoelectric device in thermal contact with the first thermally-activated active material apparatus and characterized by a first thermal differential when current flows through the first thermoelectric device; wherein the first thermally-activated active material apparatus is activated in response to the first thermal differential to alter at least one physical property of the first thermally-activated active material apparatus;

a second thermoelectric device in thermal contact with the second thermally-activated active material apparatus and characterized by a second thermal differential when current flows through the second thermoelectric device; wherein the second thermally-activated active material apparatus is activated in response to the second thermal differential to alter at least one characteristic of the second thermally-activated active material apparatus;

a first electronic-insulating layer surrounding each of the thermoelectric devices and the first and the second active material apparatus to thereby connect the first and the second active material apparatus as a unit; wherein the first active material apparatus is spaced from the second active material apparatus within the first electronic-insulating layer with the first electronic-insulating layer between the first and the second thermoelectric devices;

a second electronic-insulating layer positioned between the first thermally-activated active material apparatus and the first thermoelectric device and having a generally electronic-insulating characteristic to insulate the first thermally-activated active material apparatus from current flow in the first thermoelectric device; and wherein the second electronic-insulating layer is a shape memory polymer configured to change length in the same direction as the first and the second thermally-activated active material apparatus in response to heat.

2. The active material assembly of claim 1, wherein the first thermoelectric device includes at least one negatively-doped thermoelement and at least one positively-doped thermoelement connected electrically in series and thermally in parallel with one another.

3. The active material assembly of claim 1, wherein the first thermoelectric device includes a first metal contact layer positioned between the second electronic-insulating layer and the thermoelements.

4. The active material assembly of claim 1, wherein the first thermally-activated active material apparatus is a shape memory material; and wherein the first metal contact layer is a shape memory alloy.

* * * * *